US006955459B2

(12) United States Patent
Mochizuki et al.

(10) Patent No.: US 6,955,459 B2
(45) Date of Patent: Oct. 18, 2005

(54) VEHICULAR MARKER LAMP

(75) Inventors: Miki Mochizuki, Shizuoka (JP); Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 122 days.

(21) Appl. No.: 10/640,841

(22) Filed: Aug. 14, 2003

(65) Prior Publication Data

US 2004/0047161 A1 Mar. 11, 2004

(30) Foreign Application Priority Data

Sep. 9, 2002 (JP) ..... 2002-263288

(51) Int. Cl.[7] ..... F21V 7/04; F21V 13/04

(52) U.S. Cl. ..... 362/602; 362/540; 362/612; 362/601; 362/545; 362/511; 362/555; 362/800

(58) Field of Search ..... 362/602, 540, 362/612, 601, 545, 511, 555, 800, 31, 558, 541; 340/479

(56) References Cited

U.S. PATENT DOCUMENTS 5,711,592 A * 1/1998 Hotta ..... 362/496
5,791,757 A * 8/1998 O'Neil et al. ..... 362/556
6,102,559 A * 8/2000 Nold et al. ..... 362/558

FOREIGN PATENT DOCUMENTS

JP 11-306810 11/1999
JP 2000-251508 9/2000

* cited by examiner

*Primary Examiner*—Thomas M. Sember
*Assistant Examiner*—James W Cranson, Jr.
(74) *Attorney, Agent, or Firm*—Koda & Androlia

(57) ABSTRACT

A vehicular marker lamp including an auxiliary light emitting portion disposed near a tail/stop lamp (a main light emitting portion) having a red exterior appearance which is a lamp function color of the tail/stop lamp. The auxiliary light emitting portion is structured by a colorless and transparent light guide plate and a plurality of red light emitting diodes disposed so as to allow light from the light emitting diodes to be incident to the light guide plate so that when the tail/stop lamp is lit the light guide plate emits red light by the light which is incident from the light emitting diodes.

15 Claims, 8 Drawing Sheets

VEHICULAR MARKER LAMP

BACKGROUND OF THE INVENTION

1. Field of the Invention

The present invention relates to a vehicular marker lamp that lights in a predetermined lamp function color.

2. Prior Art

A typical vehicular marker lamp that uses light emitting diodes for its light source is disclosed in Japanese Patent Application Laid-Open (Kokai) No. 11-306810. In the vehicular marker lamp disclosed in Japanese Patent Application Laid-Open (Kokai) No. 2000-251508, the light source is a light emitting diode, and this lamp uses a light guide plate.

In recent vehicular marker lamps, due to new type of light sources such as light emitting diodes and high precision design methods and the like that uses a CAD system, the lamp chamber is made compact, but the lamp still has the required lamp light distribution function.

With such a compact lamp chamber structure, it is now possible to reduce the overall size of the lamp. Accordingly, the area of a portion that has an exterior appearance of the lamp function color on the surface of a vehicle body is reduced, making it possible to increase the flexibility of a vehicle design.

However, when structuring the lamp chamber compact, the light emitting area becomes smaller accordingly. Therefore, even if the required lamp light distribution function is secured in such a compact lamp, a problem arises in which the marker lamp tends to have difficulty in sufficiently exerting its fundamental function.

Namely, vehicular marker lamps have the function to display the intention of the driver, such as stopping of the vehicle or changing of lane, to the vehicles behind. Thus, if the light emitting area is reduced and mall, it becomes difficult for the drivers behind and the like to recognize that the lamp, which is a problem. In particular, the possibility that the driver behind is an elderly is considerable in the aging society of recent years, and thus attention to allow easier recognition of the lit lamp by the drivers behind and the like has become especially desirable.

SUMMARY OF THE INVENTION

Accordingly, it is an object of the present invention to provide a vehicular marker lamp that is capable of securing sufficient light emitting area when the lamp is lit, even if the lamp chamber is compact.

The present invention accomplishes the object above by providing an auxiliary light emitting portion.

More specifically, the above object is accomplished by a unique structure of the present invention for a vehicular marker lamp that lights in a predetermined lamp function color and comprises a main light emitting portion, which has a predetermined chromatic exterior appearance and lights with the lamp function color, and an auxiliary light emitting portion, which is disposed adjacent to the main light emitting portion; and the auxiliary light emitting portion is provided with a substantially colorless and transparent light guide plate and a light source disposed such that light thereof is incident to the light guide plate, the auxiliary light emitting portion being structured such that, when the main light emitting portion is lit, the light guide plate emits light with a color that is substantially identical to the lamp function color of the main light emitting portion by light incident from the light source.

The specific type of the "vehicular marker lamp" is not particularly limited. For example, a tail lamp, stop lamp, tail/stop lamp, turn signal lamp, and the like can be the "vehicular marker lamp," and the vehicular marker lamp may be a combination lamp or the like equipped with a plurality of lamp functions.

The "lamp function color" signifies an emitted light color required to fulfill the lamp function of the vehicular marker lamp when the lamp is lit. For instance, red in cases where the vehicular marker lamp is a tail lamp is the "lamp function color", and the "lamp function color" is amber when the vehicular marker lamp is a turn signal lamp.

The specific structure of the "main light emitting portion" is not particularly limited as long as it includes a predetermined chromatic exterior appearance and lights in a lamp function color.

The "predetermined chromatic exterior appearance" is an appearance of the vehicular lamp of a predetermined chromatic color that is seen when the vehicular marker lamp when it is not lit is seen from the front of the lamp. The predetermined chromatic color may be the same color as the lamp function color, or it can be a color different from the lamp function color so long as it is chromatic.

The "light source" of the auxiliary light emitting portion can be the light source provided exclusively for use in the auxiliary light emitting portion, or it can be a light source used in combination with the main light emitting portion. Also, the type, quantity and the like of the light source of the auxiliary light emitting portion are not particularly limited.

The specific structure of the "light guide plate", including the material and shape, is not particularly limited so long as the light guide plate is substantially a colorless and transparent plate member capable of emitting light with light incident from the light source of the auxiliary light emitting portion. A "substantially colorless and transparent" plate member naturally includes a colorless and transparent plate member, and such a plate member can be a slightly colored or semitransparent so long as the color of light from the auxiliary light emitting portion is within the range in which the light guide plate is capable of emitting light substantially identical in color to the lamp function color of the main light emitting portion with light incident from the light source.

As seen from the above, in the vehicular marker lamp of the present invention, a main light emitting portion, which has a predetermined chromatic exterior appearance and lights with its lamp function color, and an auxiliary light emitting portion, which is disposed adjacent to the main light emitting portion, are provided; and the auxiliary light emitting portion has a substantially colorless and transparent light guide plate and a light source disposed so that light thereof is incident to the light guide plate, and this auxiliary light emitting portion is structured so that when the main light emitting portion is lit the light guide plate emits light that has a color substantially identical to the lamp function color of the main light emitting portion by light incident from the light source. Because of this structure, the vehicular marker lamp of the present invention has several advantages.

First, when the lamp is not lit, the main light emitting portion appears in a predetermined chromatic color, while the auxiliary light emitting portion appears substantially colorless and transparent, which is the color of the light guide plate, or appears partially whitish due to the inner surface reflecting effect. Accordingly, the area of the portion having the predetermined chromatic exterior appearance can be small on the surface of a vehicle body. On the other hand, when the lamp is lit, not only does the main light emitting portion appears in its lamp function color, but the light guide plate of the auxiliary light emitting portion also appears in a color that is substantially identical to the lamp function color of the main light emitting portion. Thus, the lamp as a whole has an increased light emitting area by that extra amount brought by the auxiliary light emitting portion.

In addition, according to the present invention, in a vehicular marker lamp constructed so as to light with a predetermined lamp function color, a sufficient light emitting area when the lamp is lit is secured even if the lamp chamber is compact. Thus, the level of flexibility in vehicle designing is high; and the fundamental function of a vehicular marker lamp that is to allow the drivers behind and the like to recognize the lighting of the lamp is sufficiently exerted.

In the present invention, the light source type, quantity and the like for the auxiliary light emitting portion are not particularly limited as described above. However, by way of employing a plurality of light emitting diodes for the auxiliary light emitting portion, it is possible to direct light incident to the light guide plate in a plurality of locations, thereby easily enabling a substantially uniform light emission from the light guide plate.

Furthermore, the light source of the main light emitting portion can be used also for the light source of the auxiliary light emitting portion. In this structure, the light guide plate of the auxiliary light emitting portion can emit light without increasing the number of light sources, thereby allowing the lamp costs to be suppressed by that amount.

In the above structure, the light guide plate can be formed in substantially a fan shape with the main light emitting portion disposed at the apex position of such a fan shape or at a position on an outer edge region of the lamp. With this structure, when the lamp is turned on and off, the substantially fan-shaped area adjacent to the inner or outer peripheral side of the main light emitting portion appears to be increased (when the lamp is turned on) or decreased (when the lamp is turned off) as a light emitting portion that has a color substantially identical to the lamp function color. Thus, the lamp has an unprecedented new appearance.

In this case, the light guide plate can be provided with a plurality of belt-shaped reflecting areas extending in a radial pattern, and in addition each of the belt-shaped reflecting areas can be provided with a plurality of reflective elements in a stepped configuration that reflects light from the light source in the forward direction of the lamp. With this structure, the light guide plate can emit substantially uniform light in a discrete manner so as to conform to the substantially fan-shape light guide plate.

In the above marker lamp, a plurality of different types of main light emitting portions that have respectively different lamp function colors can be provided for the main light emitting portion, so that the light guide plate of the auxiliary light emitting portion emits light with a color substantially identical to the lamp function color of the main light emitting portion when a particular main light emitting portion among the plurality of types of main light emitting portions is lit. With this structure, the above described functions and advantages are obtained in a predetermined lighting mode even in a combination lamp equipped with a plurality of lamp functions.

In this case, the auxiliary light emitting portion can be provided with a plurality of different types of light sources for its light source so that when the main light emitting portions are turned on and off light from the different types of light sources is incident to the light guide plate of the auxiliary light emitting portion. Thus, the light guide plate can appear in a color that is substantially identical to the lamp function color in a plurality of lighting modes, allowing the light guide plate to have a variety of appearances.

DETAILED DESCRIPTION OF THE INVENTION

Preferred embodiments of the present invention will be described below with reference to the accompanying drawings.

Figure 1:
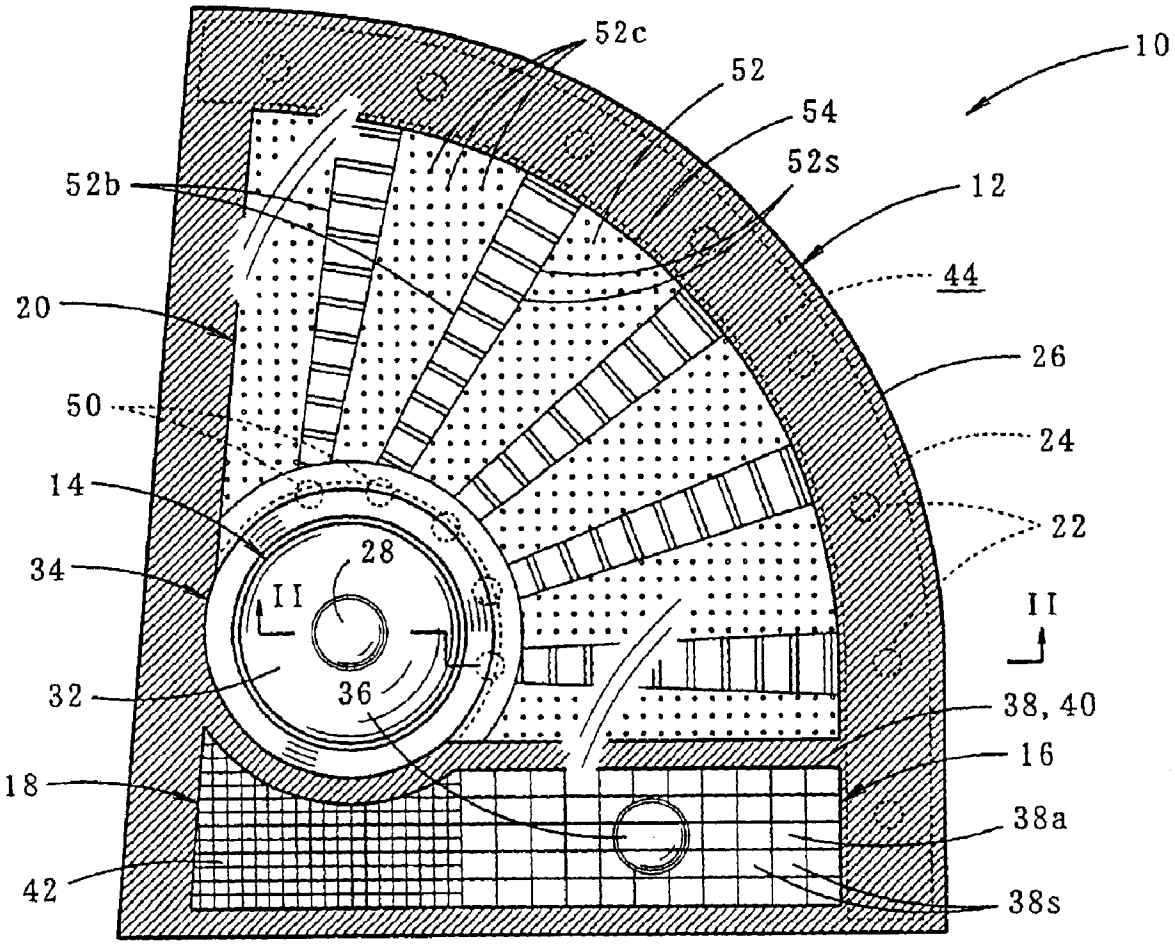
FIG. 1 is a front elevational view of the vehicular marker lamp according to the first embodiment of the present invention.
Figure 2:
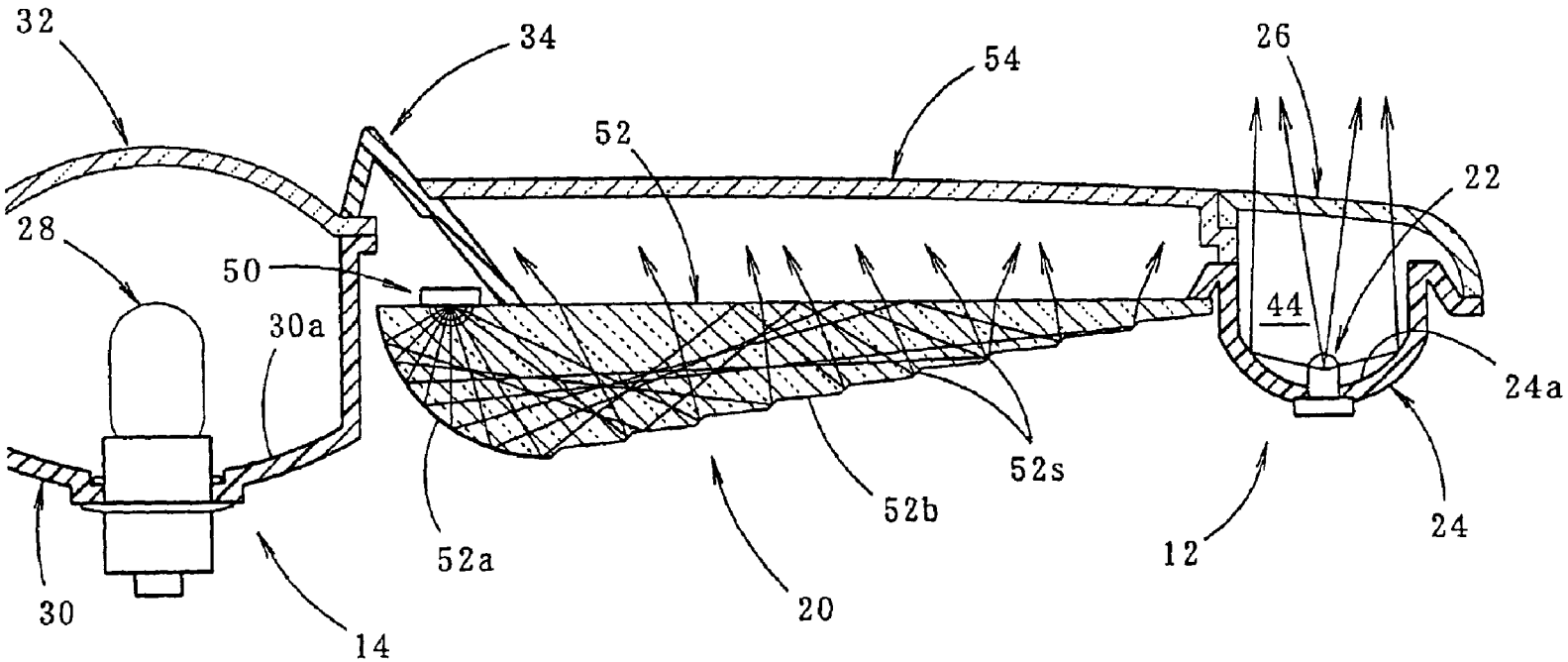
FIG. 2 is a cross-sectional view taken along the line II—II in FIG. 1.

As seen from FIGS. 1 and 2, the vehicular marker lamp 10 of the first embodiment is a rear combination lamp, and it is mounted in the rear end portion on the right side of a vehicle. The vehicular marker lamp 10 comprises a tail/stop lamp 12, a backup lamp 14, a turn signal lamp 16, a reflex reflector 18, and an auxiliary light emitting portion 20. The directions such as forward and rearward in the description below are the directions of the vehicular marker lamp 10, thus being opposite from the (forward or rearward) direction of the vehicle.

In this first embodiment, the tail/stop lamp 12, the backup lamp 14, and the turn signal lamp 16 each makes the main light emitting portions, and the auxiliary light emitting portion 20 emits light of the lamp function color of the tail/stop lamp 12 when the tail/stop lamp 12 is lit.

The vehicular marker lamp 10 has a substantially fan-shaped outer configuration when viewed from the front of the lamp (or from the back of the vehicle), and the tail/stop lamp 12 is disposed at a position on an outer edge region thereof. The tail/stop lamp 12 is a belt-shaped lamp extending in a substantially arc shape, and the auxiliary light emitting portion 20 is disposed inside thereof. The auxiliary light emitting portion 20 has a substantially fan shape, and the circular backup lamp 14 is disposed at the apex position of such a fan shape. The turn signal lamp 16 and the reflex reflector 18 are disposed below the auxiliary light emitting portion 20 and the backup lamp 14. The turn signal lamp 16 is in a horizontally oblong shape, and the reflex reflector 18 is in a substantially horizontally oblong shape having a concave arc portion on the upper portion.

The tail/stop lamp 12 is formed from a plurality of red light emitting diodes 22, a lamp body 24 and a transparent red translucent cover 26. The red light emitting diodes 22 are disposed at predetermined intervals along the substantially fan-shaped outer edge region, and the lamp body 24 supports these light emitting diodes 22. The transparent red translucent cover 26 of the tail/stop lamp 12 covers the lamp body 24. The tail/stop lamp 12 is designed to radiate direct light from each light emitting diodes 22 and reflected light of the reflecting surface 24*a* of the lamp body 24 through the translucent cover 26 in the forward direction of the lamp.

In this tail/stop lamp 12, all the light emitting diodes 22 light in the tail lamp lighting mode and in the stop lamp lighting mode. The luminance of each light emitting diodes 22 is set so that it is brighter in the stop lamp lighting mode than in the tail lamp lighting mode.

The translucent cover 26, as shown in the area shaded with diagonal lines in FIG. 1, is provided in the front area of a lamp chamber 44 formed by the lamp body 24 and the translucent cover 26, and it extends so as to outline the entire periphery of the outer edge region of the vehicular marker lamp 10. Furthermore, the translucent cover 26 is formed as a divider; in other words, it extends between the auxiliary light emitting portion 20 and the backup lamp 14 and between the turn signal lamp 16 and the reflex reflector 18.

The backup lamp 14 is comprised of a colorless incandescent bulb 28, a lamp body 30 that supports the incandescent bulb 28, and a dome-shaped semi-translucent cover 32 covering the lamp body 30. The inner surface of the semi-translucent cover 32 is treated by a frosting process, thus showing a frosted glass appearance. The backup lamp 14 radiates direct light from the incandescent bulb 28 and reflected light of the reflecting surface 30*a* of the lamp body 30 through the semi-translucent cover 32 in the forward direction of the lamp (which is in the rearward direction of the vehicle). The lamp body 30 is integral with the lamp body 24 of the tail/stop lamp 12. In addition, a toric molding 34 that is treated with a chrome plating process on its surface is attached to the outer edge region of the translucent cover 32.

The turn signal lamp 16 is comprised of an amber incandescent bulb 36, a lamp body 38 that supports the incandescent bulb 36, and a colorless and transparent translucent cover 40 that covers the lamp body 38. The lamp body 38A is formed with reflecting surface 38*a*, and a plurality of reflective elements 38*s* are disposed in vertical stripes on reflecting surface 38*a*. The lamp body 38 is integral with the lamp body 24 of the tail/stop lamp 12. The translucent cover 40 of the turn signal lamp 16 is integrally formed with the translucent cover 26 of the tail/stop lamp 12 by insert molding and is provided with bands that constitute horizontally striped design lines on its inner surface. The turn signal lamp 16 radiates direct light from the incandescent bulb 36 and reflected light of the reflecting surface 38*a* of the lamp body 38 through the translucent cover 40 in the forward direction of the lamp (which is in the rearward direction of the vehicle).

The reflex reflector 18 is comprised of the lamp body 38 and the translucent cover 40 in common with the turn signal lamp 16. The reflex reflector 18 is structured so that a red reflex reflector body 42 is disposed inside the lamp body 38.

The auxiliary light emitting portion 20 is comprised of a plurality of red light emitting diodes 50, a colorless and transparent light guide plate 52, and a colorless and transparent translucent cover 54 that covers the light guide plate 52.

The light guide plate 52 is in a substantially fan shape when viewed from the front of the lamp, and the light emitting diodes 50 are provided at the apex position of the fan shaped light guide plate 52. The light emitting diodes 50 are disposed so as to face the back of the lamp (see FIG. 2) at predetermined intervals in the circumferential direction (see FIG. 1) along the molding 34 at a position behind the molding 34.

The auxiliary light emitting portion 20 is designed so that when the tail/stop lamp 12 is lit, the light emitting diodes 50 of the auxiliary light emitting portion 20 are lit and as a result the light guide plate 52 emits light of a lamp function color, i.e., red, of the tail/stop lamp 12 by the light incident from the plurality of light emitting diodes 50.

All the light emitting diodes 50 are lit when the tail/stop lamp 12 is lit in the tail lamp lighting mode and in the stop lamp lighting mode; and the luminance of each light emitting diodes 50 is set to be brighter in the stop lamp lighting mode than in the tail lamp lighting mode.

The structure of the light guide plate 52 will be described below in detail.

As seen from FIG. 2, the cross-sectional shape of the light guide plate 52 in its radial direction is set to be a substantially wedge shape.

The surface of the light guide plate 52 which is on the front side of the lamp (rear side of the vehicle) is flat. On the other hand, the surface of the light guide plate 52 which is on the rear side of the lamp is formed so that the end portion area (52*a*) of the inner peripheral side (left side in FIG. 2) is in an arc shape in cross-section, and the outer peripheral areas gradually decreases in thickness toward the outer edge (toward the right side in FIG. 2).

The above-described end portion area of the inner peripheral side of the light guide plate 52 makes a reflecting surface 52*a* that is applied with reflective treatment by aluminum vapor deposition or the like.

As seen from FIG. 1, a plurality of belt-shaped reflecting areas 52*b* extending in a radial pattern from the position of each light emitting diode 50 are formed on the outer peripheral area of the rear side surface of the light guide plate 52. A plurality of reflective elements 52*s* that reflect light incident to the light guide plate 52 from each light emitting diode 50 in the forward direction of the lamp are formed in a stepped configuration at predetermined intervals in the radial direction on each one of the belt-shaped reflecting areas 52*b*. It should be noted that light from the light emitting diodes 50 incident to these reflective elements 52*s* includes, in addition to the direct light of the light emitting diodes 50, reflected light from the reflecting surface 52*a* and light repeatedly reflected internally on the surface of the light guide plate 52.

Numerous stippled portions 52*c* are formed with a substantially uniform distribution on areas other than the belt-shaped reflecting areas 52*b* of the outer peripheral area on the front surface of the light guide plate 52. Light incident to the light guide plate 52 from each light emitting diode 50 is reflected in the forward direction of the lamp by the stippled portion 52*c* as well.

The color appearance of each one of the portions or areas described above when the vehicular marker lamp 10 which is not lit is viewed from the front of the lamp is as described below.

As to the tail/stop lamp 12, the red color of the translucent cover 26 appears. The semi-translucent cover 32 of the backup lamp 14 appears whitish like a frosted glass. For the turn signal lamp 16, the amber color of the incandescent bulb 36 reflected on the reflecting surface 38*a* of the lamp body 38 appears through the translucent cover 40. As to the reflex reflector 18, a red color of the reflex reflector body 42 appears through the translucent cover 40. As to the auxiliary light emitting portion 20, the light guide plate 52 appears partially whitish due to internal reflection or colorless and transparent through the translucent cover 54.

Furthermore, the molding 34 on the periphery of the backup lamp 14 appears silver gray. The outer edge region of the vehicular marker lamp 10 appears to be outlined in red along the entire edge area due to the translucent cover 26 of the tail/stop lamp 12 which is extendedly formed as described above. The portion between the auxiliary light emitting portion 20 and the backup lamp 14, and the portion between the turn signal lamp 16 and the reflex reflector 18 also appear to be outlined in red.

Figure 3:
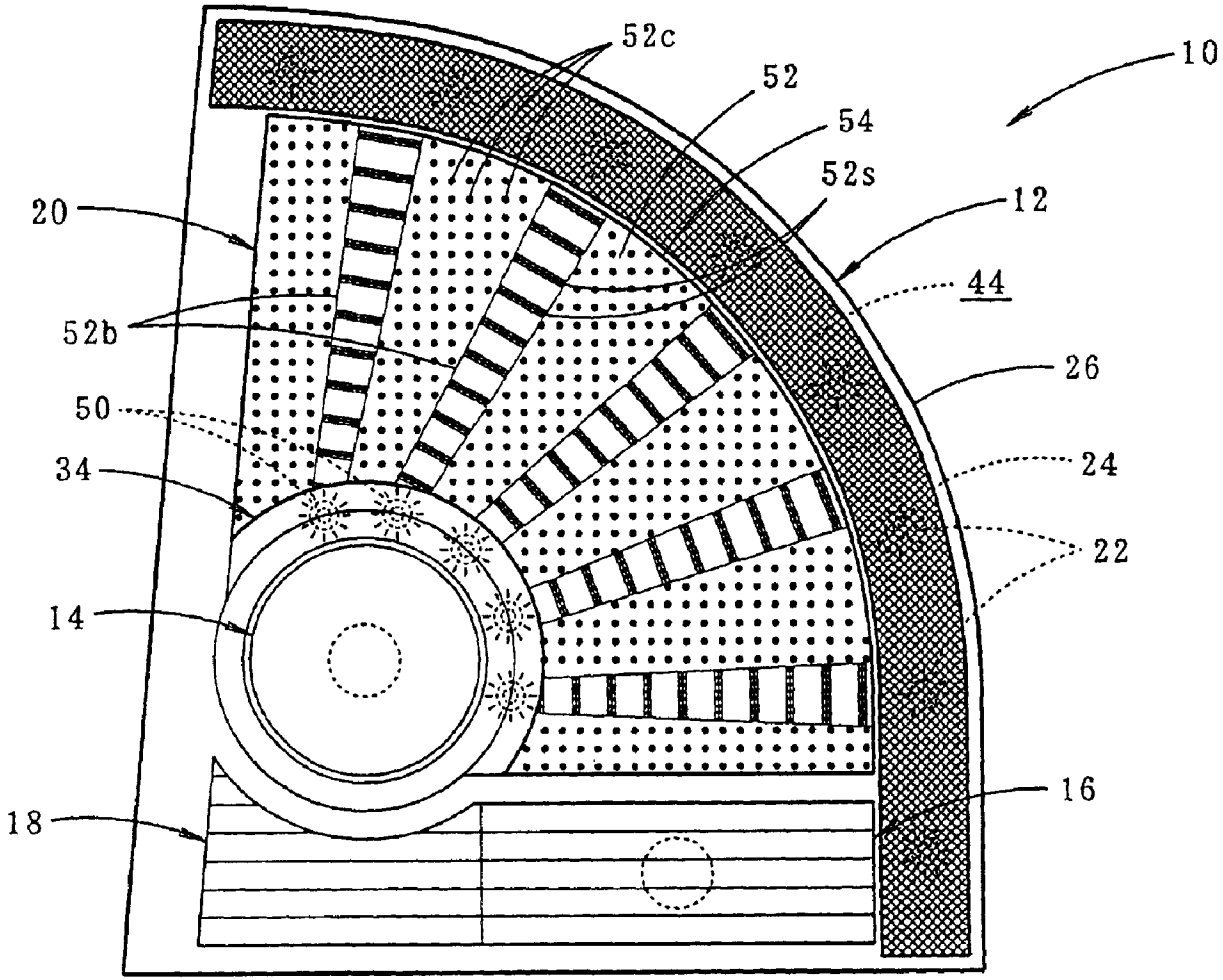
FIG. 3 is a front elevational view of the vehicular marker lamp of the first embodiment with a tail/stop lamp thereof lit in a tail lamp lighting mode.

FIG. 3 shows the vehicular marker lamp 10 of the first embodiment with the tail/stop lamp 12 lit in a tail lamp lighting mode.

As seen from FIG. 3, when the vehicular marker lamp 10 is viewed from the front of the lamp (or from the back of the vehicle), the lamp chamber 44 of the tail/stop lamp 12 appears in red that is a lamp function color of the tail/stop lamp 12 by the plurality of light emitting diodes 22. In the tail lamp lighting mode, the area of the light guide plate 52 of the auxiliary light emitting portion 20 appears to have the lamp function color (red) by the plurality of red light emitting diodes 50. In this case, in the light guide plate 52, each reflective element 52*s* on the plurality of belt-shaped reflecting areas 52*b* that extend in the radial pattern appears in a banded form, and the plurality of stippled portions 52*c* formed in the areas other than the belt-shaped reflecting areas 52*b* appear in a scattered manner.

When the tail/stop lamp 12 is in a stop lamp lighting mode, the luminance of each light emitting diode 22 and 50 is, as described above, brighter than in the tail lamp lighting mode, and therefore, the overall brightness of the vehicular marker lamp 10 is higher.

As described in detail above, in the vehicular marker lamp 10 of the first embodiment, the auxiliary light emitting portion 20 is provided near the tail/stop lamp 12 that has a red exterior appearance which is the lamp function color of the tail/stop lamp 12. The auxiliary light emitting portion 20 has the colorless and transparent light guide plate 52 and the plurality of red light emitting diodes 50, and these red light emitting diodes 50 are disposed so that light thereof is incident to the light guide plate 52. In addition, when the tail/stop lamp 12 is lit, the light guide plate 52 of the auxiliary light emitting portion 20 emits red light by the light which is incident from the light emitting diodes 50. Because of the structure above, the vehicular marker lamp 10 of the first embodiment is characterized as describe below.

When the lamp is not lit, while the tail/stop lamp 12 appears red, the auxiliary light emitting portion 20 shows the color of the light guide plate 52, which is colorless and transparent, or it appears partially whitish due to internal reflection thereof. Therefore, the surface area of a portion that has a red appearance on the surface of the vehicle body can be small. When on the other hand the lamp is lit in the tail lamp lighting mode or in the stop lamp lighting mode, not only does the lamp chamber 44 of the tail/stop lamp 12 appears red, but the light guide plate 52 of the auxiliary light emitting portion 20 appears red also. Thus, the light emitting area that appears red increases by that extra amount brought by the auxiliary light emitting portion 20.

In the vehicular marker lamp 10 of this embodiment, since the surface area of the portion that has a red exterior appearance for use in the tail/stop lamp 12 can be small, it is possible to use the remaining portion that has the red exterior appearance for lamp design. In other words, the translucent cover 26 of the tail/stop lamp 12 is formed not only in the front area of the lamp chamber 44, but it is formed also so as to extend along the outline of the entire area of the outer edge region of the vehicular marker lamp 10 and to extend such that the auxiliary light emitting portion 20 and the backup lamp 14, and the turn signal lamp 16 and the reflex reflector 18 are divided. Accordingly, it is possible to increase the novelty of the lamp design.

As seen from the above, in the shown first embodiment, even if the lamp chamber 44 of the tail/stop lamp 12 is structured compact, sufficient light emitting area when the tail stop lamp 12 is lit is secured. Thus, the level of flexibility in vehicle design is high; and in addition, the fundamental function of the marker lamp which is to let the drivers and the like behind recognize the lighting of the tail/stop lamp 12 is sufficiently exerted.

Further, the light source of the auxiliary light emitting portion 20 is comprised of a plurality of light emitting diodes 50. Accordingly, light of light emitting diodes 50 can be incident to the light guide plate 52 in a plurality of locations, and the light guide plate 52 emits light in a uniform fashion.

Furthermore, since the light guide plate 52 is in a substantially fan shape, and the tail/stop lamp 12 is disposed on an outer edge region thereof, the substantially fan-shaped area adjacent to the inner peripheral side of the tail/stop lamp 12 appears, upon turning on and off the lamp, to be increased or decreased as a light emitting portion of the lamp function color. Thus, the lamp has an unprecedented new appearance.

In addition, the light guide plate 52 has a plurality of belt-shaped reflecting areas 52*b* that extend in a radial pattern, and a plurality of reflective elements 52*s* that reflect light from each of the light emitting diodes 50 toward the front of the lamp are formed in a stepped configuration in each of these belt-shaped reflecting areas 52*b*. Therefore, the light guide plate 52 emits substantially uniform light in a discrete manner that conforms to the substantially fan shape. Moreover, the plurality of stippled portions 52*c* are formed in a substantially uniform distribution in areas other than each of the belt-shaped reflecting areas 52*b* of the outer peripheral areas on the rear surface of the light guide plate 52. Accordingly, light which is incident to the light guide plate 52 from each of the light emitting diodes 50 is reflected toward the front of the lamp by the stippled portions 52*c* as well, and the light guide plate 52 is enable to light in further uniformed manner.

Next, the second embodiment of the present invention will be described with reference to FIGS. 4 and 5.

Figure 4:
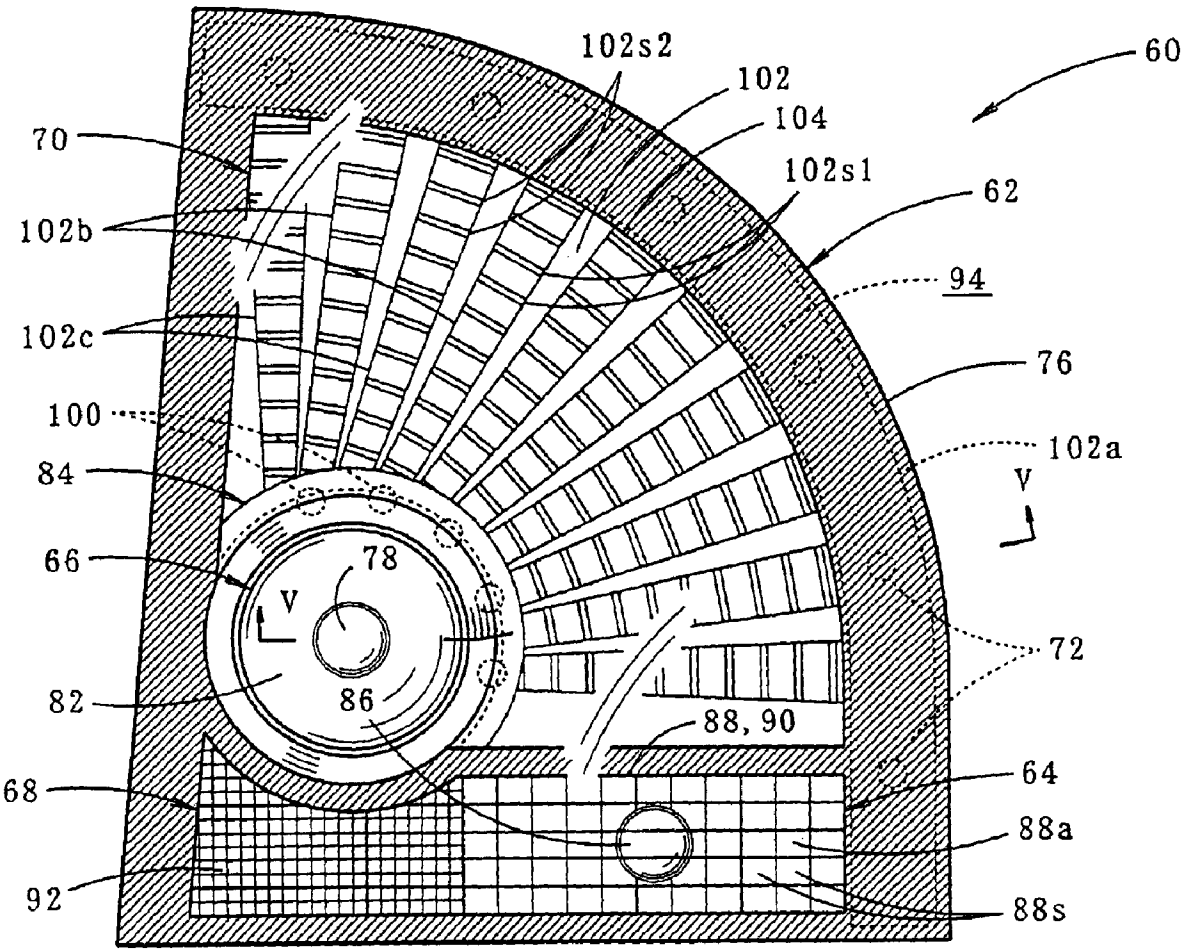
FIG. 4 is a front elevational view of the vehicular marker lamp according to the second embodiment of the present invention.
Figure 5:
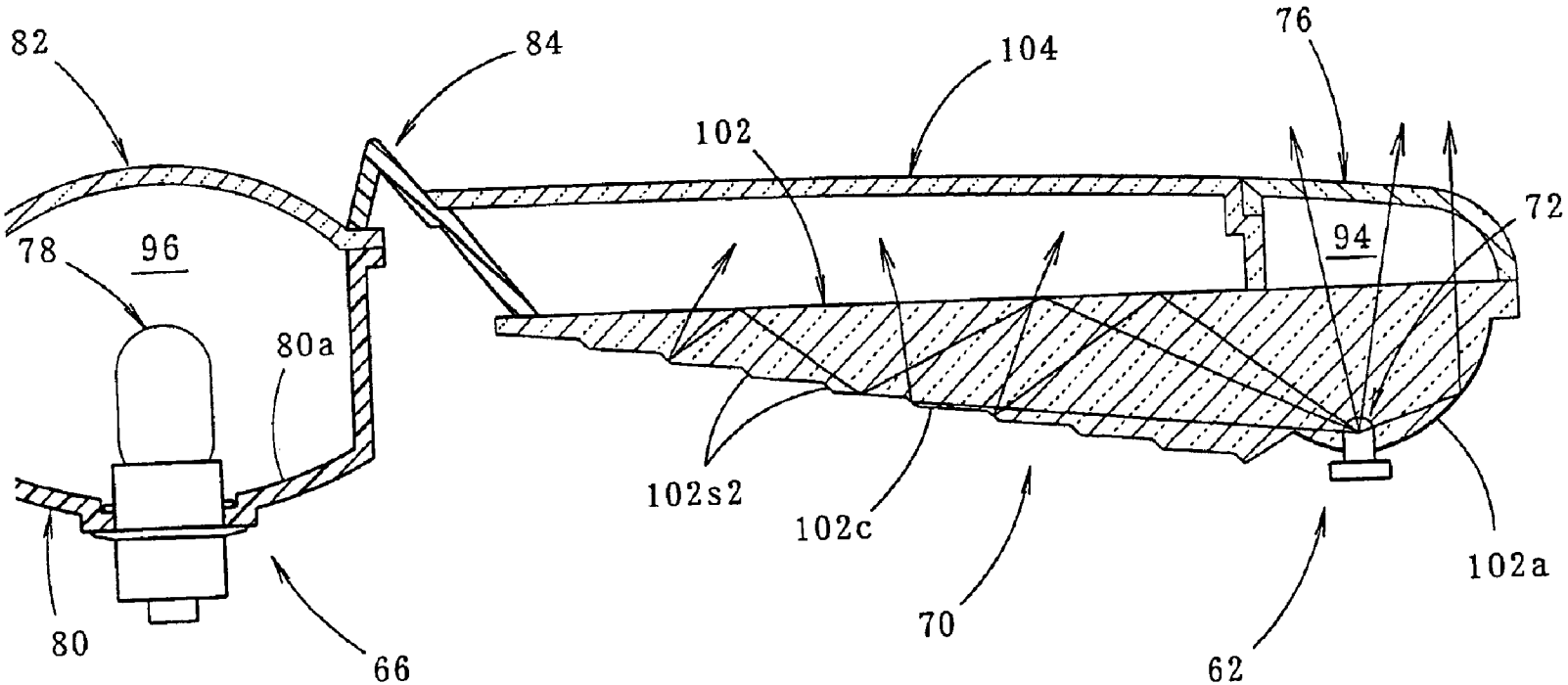
FIG. 5 is a cross-sectional view taken along the line V—V in FIG. 4.

As seen from FIGS. 4 and 5, the basic structure of the vehicular marker lamp 60 of the second embodiment is identical to the vehicular marker lamp 10 of the first embodiment. However, in this second embodiment, not only does the auxiliary light emitting portion 70 light in the lamp function color of a tail/stop lamp 62 when the tail/stop lamp 62 is lit, but the auxiliary light emitting portion 70 lights also in the lamp function color of a turn signal lamp 66 when the turn signal lamp 66 is lit.

More specifically, the turn signal lamp 66 in this second embodiment is disposed at a position where the backup lamp 14 is provided in the first embodiment, and a backup lamp 64 is provided at a position where the turn signal lamp 16 is provided in the first embodiment. In the second embodiment, the turn signal lamp 66 has a translucent cover 82 that is colorless and transparent.

In addition, a plurality of amber light emitting diodes 100 and a plurality of red light emitting diodes 72 are provided for the light source of the auxiliary light emitting portion 70. In other words, the amber light emitting diodes 100 are used for lighting the auxiliary light emitting portion 70 in the lamp function color (amber) of the turn signal lamp 66 when the turn signal lamp 66 is lit, and they are provided in a position where the plurality of red light emitting diodes 50 are provided the first embodiment. On the other hand, the red light emitting diodes 72 are used for lighting the auxiliary light emitting portion 70 in the lamp function color (red) of the tail/stop lamp 62 when the tail/stop lamp 62 is lit. In other words, as best seen from FIG. 5, the red light emitting diodes 72 are dually used for the light source of the tail/stop lamp 62 and for the light source of the auxiliary light emitting portion 70.

In this second embodiment as well, the light guide plate 102 of the auxiliary light emitting portion 70 is in a substantially fan shape when viewed from the front of the lamp. In addition, the light guide plate 102 is formed so that a plurality of belt-shaped reflecting areas 102*b* are formed to extend in a radial pattern with a structure completely identical to the belt-shaped reflecting areas 52*b* of the first embodiment. However, stippled portions 52*c* of the first embodiment are not formed on the light guide plate 102 of this second embodiment. Instead, a plurality of belt-shaped reflecting areas 102*c* are formed to extend in a radial pattern alternating with the plurality of belt-shaped reflecting areas 102*b*.

The structure of the belt-shaped reflecting areas 102*c* formed in the light guide plate 102 will be described below in detail.

As seen from FIG. 5, the portion in which the belt-shaped reflecting areas 102*c* are formed in the light guide plate 102 has a substantially wedge shape in cross-section in the radial direction.

The front surface of the light guide plate 102 is flat; however, the rear side surface is formed so that the end portion area (102*a*) of the outer peripheral side is formed in a parabolic shape in cross-section, and the inner peripheral area is formed such that the thickness of the light guide plate 102 gradually decreases toward the inner edge area (toward the left side in FIG. 5).

The end portion area of the outer peripheral side on the rear surface of the lamp guide plate 102 is a reflecting surface 102*a* that is applied with reflective treatment by aluminum vapor deposition and the like. The reflecting surface 102*a* extends in a substantially arc shape along the outer edge region of the light guide plate 102 on the rear side of the translucent cover 76. Each light emitting diode 72 faces the forward direction of the lamp and is inserted and fixed to a rear top portion of the reflecting surface 102*a* so as to be positioned on the outer peripheral side of each belt-shaped reflecting area 102*c*.

A plurality of reflective elements 102*s*2 that reflect light incident to the light guide plate 102 from each light emitting diode 72 toward the front of the lamp are formed on each one of the belt-shaped reflecting areas 102*c* in a stepped configuration at predetermined intervals in a radial pattern. Light from the light emitting diodes 72 which is incident to the reflective elements 102*s*2 includes, in addition to the direct light, light repeatedly reflected internally on the surface of the light guide plate 102. Among the lights incident to the light guide plate 102 from each light emitting diode 72, light incident to the reflecting surface 102*a* is reflected forward and is used, together with the direct light directed forward of the lamp from each light emitting diode 72, as light for the tail/stop lamp 62.

The color appearance of each one of the portions or areas described above when the vehicular marker lamp 60 which is not lit is viewed from the front of the lamp is as described below.

As to the tail/stop lamp 62, the red color of the translucent cover 76 appears. As to the backup lamp 64, the reflecting surface 88*a* of the lamp body 88 appears silver gray through the translucent cover 90. As to the turn signal lamp 66, the amber color of the incandescent bulb 78 reflected on the reflecting surface 80*a* of a lamp body 80 appears through the translucent cover 82. For the reflex reflector 68, the red color of the reflex reflector body 92 appears through the translucent cover 90. In the auxiliary light emitting portion 70, the light guide plate 102 appears partially whitish due to internal reflection or colorless and transparent through a translucent cover 104.

Furthermore, a molding 84 on the periphery of the turn signal lamp 66 appears silver gray. Also, the outer edge region of the vehicular marker lamp 60 appears to be outlined in red along the entire edge area due to the translucent cover 76 of the tail/stop lamp 62 being formed extended. The portion between the auxiliary light emitting portion 70 and the turn signal lamp 66, and the backup lamp 64 and the reflex reflector 68 also appears to be outlined in red.

Figure 6:
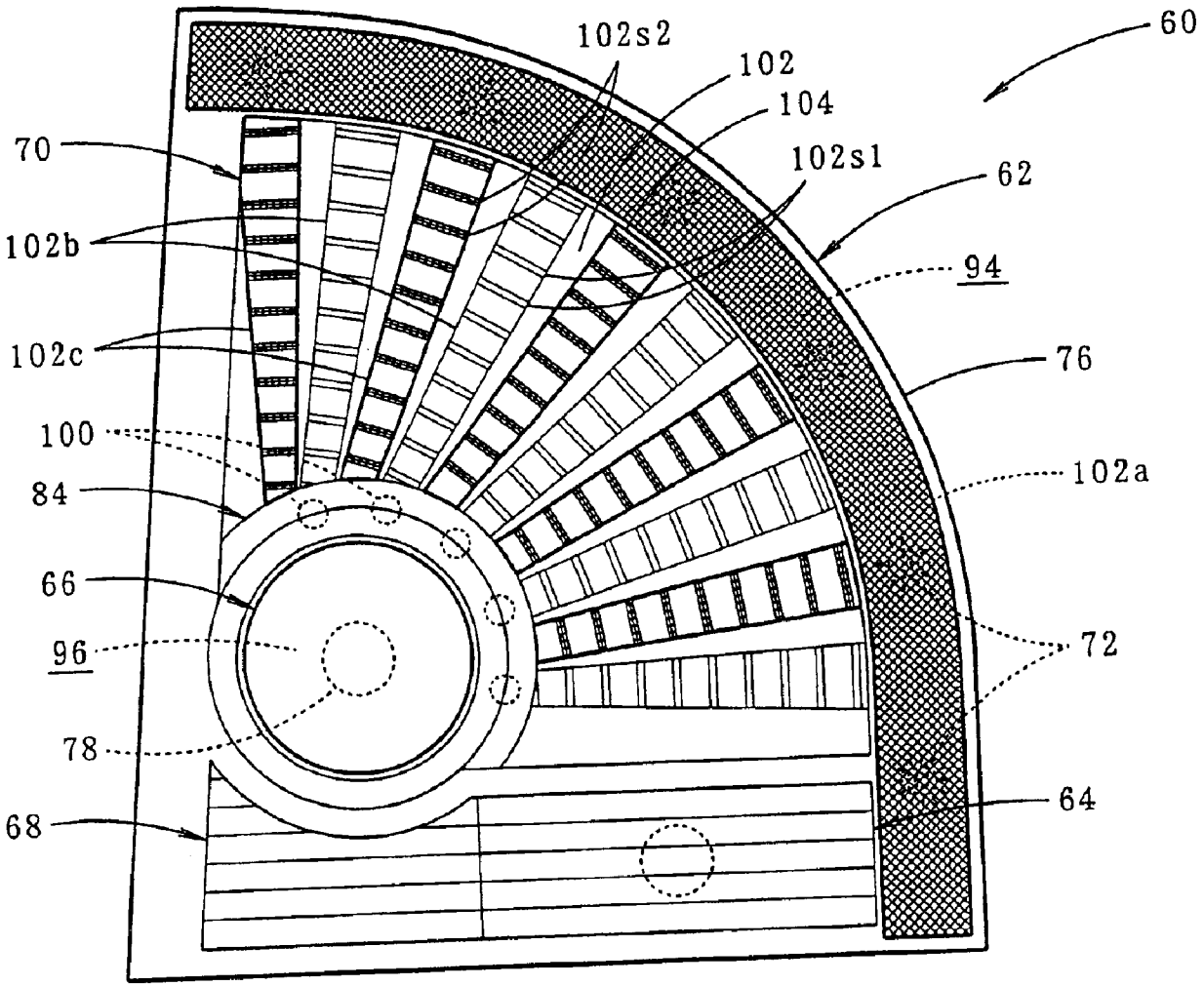
FIG. 6 is a front elevational view of the vehicular marker lamp of the second embodiment with its tail/stop lamp lit in a tail lamp lighting mode.

FIG. 6 shows the vehicular marker lamp 60 of the second embodiment with the tail/stop lamp 62 lit in the tail lamp lighting mode.

As seen from FIG. 6, when the vehicular marker lamp 60 is viewed from the front, the lamp chamber 94 of the tail/stop lamp 12 appears in red that is the lamp function color (red) by the plurality of light emitting diodes 72. In the tail lamp lighting mode, the auxiliary light emitting portion 70 appears so that the plurality of belt-shaped reflecting areas 102*c* formed on the light guide plate 102 appear in red in a radial pattern by the plurality of red light emitting diodes 72. In this case, the plurality of reflective elements 102*s*2 in each band-shaped reflecting area 102*c* appears in a banded form.

When the tail/stop lamp 62 is in the stop lamp lighting mode, the luminance of each light emitting diode 72 is, as described above, brighter than in the tail lamp lighting mode; and therefore, the overall brightness of the vehicular marker lamp 60 is higher.

Figure 7:
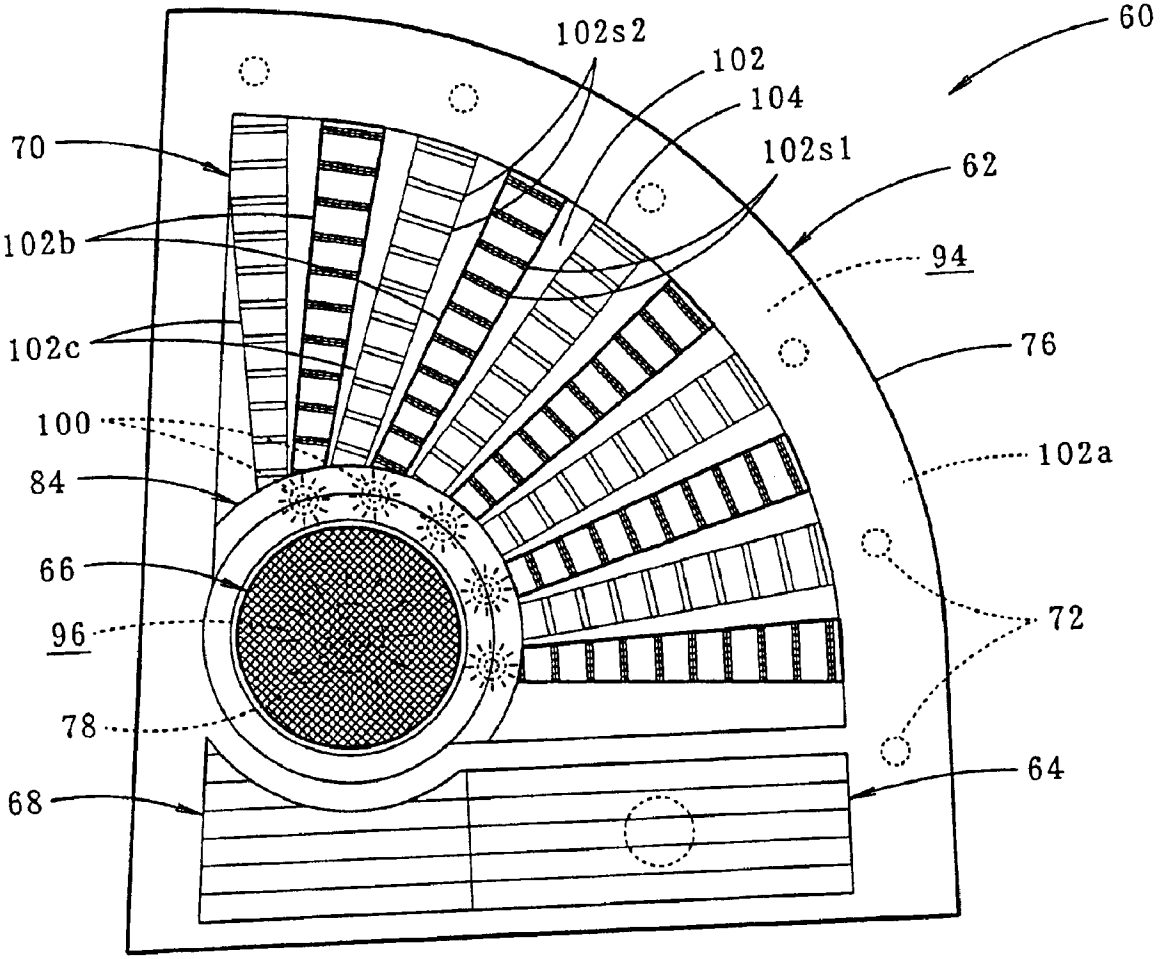
FIG. 7 is a front elevational view of the vehicular marker lamp according to the second embodiment with its turn signal lamp lit.

FIG. 7 shows the vehicular marker lamp 60 of the second embodiment when the turn signal lamp 66 is lit.

As seen from FIG. 7, when the vehicular marker lamp 60 is viewed from the front of the lamp, the lamp chamber 96 of the turn signal lamp 66 appears in amber that is the lamp function color of the turn signal lamp 66 by the amber incandescent bulb 78. On the other hand, when the turn signal lamp 66 is lit, in the auxiliary light emitting portion 70 as well, the plurality of belt-shaped reflecting areas 102*b* formed on the light guide plate 102 appears in amber in a radial pattern due to the plurality of amber light emitting diodes 100. In this case, the plurality of reflective elements 102*s*1 in each of the belt-shaped reflecting areas 102*b* appears to be lit in a banded form.

Figure 8:
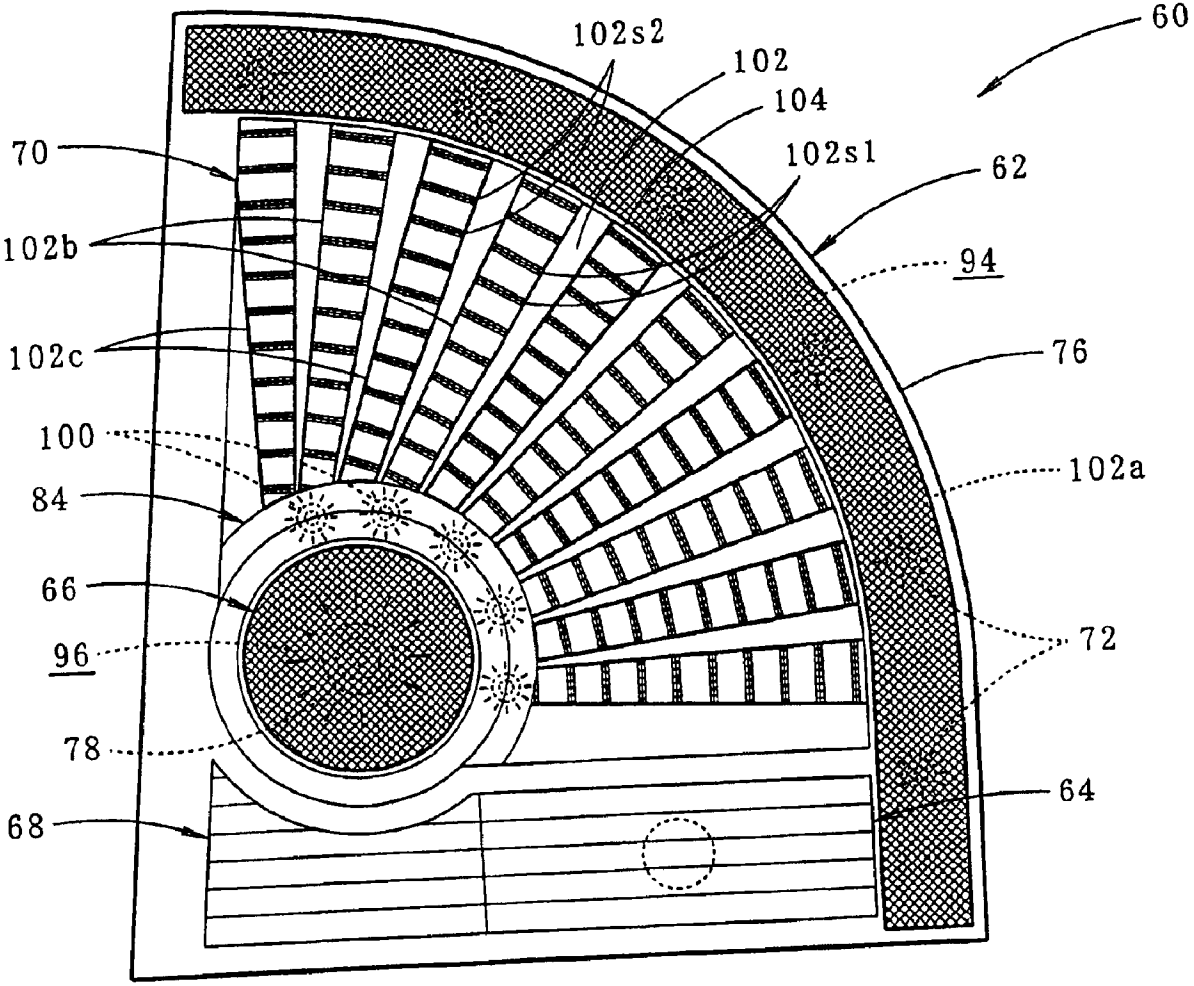
FIG. 8 is a front elevational view of the vehicular marker lamp of the second embodiment with its tail/stop lamp and turn signal lamp lit simultaneously.

FIG. 8 shows the vehicular marker lamp 60 of the second embodiment when the turn signal lamp 66 is on and the tail/stop lamp 62 is lit in the tail lamp lighting mode.

As seen from FIG. 8, when the tail/stop lamp 62 and the turn signal lamp 66 are simultaneously lit, the auxiliary light emitting portion 70 appears so that the plurality of red belt-shaped reflecting areas 102*c* and the plurality of amber belt-shaped reflecting areas 102*b* are lit together in a radial pattern.

As seen from the above, in the second embodiment of the present invention, even if the lamp chamber 94 of the tail/stop lamp 62 and the lamp chamber 96 of the turn signal lamp 66 are made compact, sufficient light emitting area when the tail stop lamp 62 or the turn signal lamp 66 is lit can be secured. Thus, the level of flexibility in vehicle design is high; and the fundamental function of the marker lamp, which is to let the drivers and the like behind recognize the lighting of the tail/stop lamp 62 or the turn signal lamp 66, is sufficiently exerted.

Moreover, since the plurality of light emitting diodes 72 are used for the light source of the tail/stop lamp 62 and for the light source of the auxiliary light emitting portion 70, the light guide plate 102 emits light without increasing the number of light sources, and lamp costs is suppressed by that amount of less number of light sources.

In addition, in the second embodiment, the tail/stop lamp 62 and the turn signal lamp 66 are disposed in the outer edge region and in the apex position of the substantially fan-shaped light guide plate 102, respectively. Accordingly, when the tail/stop lamp 62 or the turn signal lamp 66 is turned on or off, the substantially fan-shaped area adjacent to the inner peripheral side of the tail/stop lamp 12 and adjacent to the outer peripheral side of the turn signal lamp 66 can appear to be increased or decreased as a red or amber light emitting portion. The lamp thus has an unprecedented new appearance. In particular, in this second embodiment, when the tail/stop lamp 62 and the turn signal lamp 66 are simultaneously lit, the plurality of red belt-shaped reflecting areas 102*c* and the plurality of amber belt-shaped reflecting areas 102*b* appear to be lit together in a radial pattern. Therefore, the novelty of the lamp design is even higher.

In the vehicular marker lamp 10 of the first embodiment, the tail/stop lamp 12, which is the main light emitting portion of lamp 10, has a red exterior appearance that is the lamp function color of the tail/stop lamp 12. In the vehicular marker lamp 60 of the second embodiment, the tail/stop lamp 62, which is the main light emitting portion, has a red exterior appearance that is the lamp function color of the tail/stop lamp 62, and the turn signal lamp 66, which is another main light emitting portion, has an amber exterior appearance that is the lamp function color of the turn signal lamp 66. However, it is also possible to construct lamps so that the tail/stop lamps 12 and 62 and the turn signal lamp 66 have a color of, for instance, pink for their external color appearances that are different from their lamp function colors. In this case, however, it is necessary to, for instance, provide complimentary color filters and the like so that the tail/stop lamps and the turn signal lamp provide their own function color respectively.

What is claimed:

1. A vehicular marker lamp that lights in a predetermined lamp function color, comprising a main light emitting portion that has a predetermined chromatic exterior appearance and lights in said lamp function color, and an auxiliary light emitting portion disposed adjacent to said light emitting portion; wherein said auxiliary light emitting portion is comprised of a substantially colorless and transparent light guide plate and a light source which is disposed such that light thereof is incident to said light guide plate, said auxiliary light emitting portion being structured so that when said main light emitting portion is lit, said light guide plate emits light with a color substantially identical to said lamp function color of said main light emitting portion by light incident from said light source;

said light guide plate is formed in a substantially fan shape, and said light guide plate has a plurality of belt-shaped reflecting areas that extend in a radial pattern, and a plurality of reflective elements that reflect light incident from said light source in a forward direction of said vehicular marker lamp are formed in a stepped configuration on each of said plurality of belt-shaped reflecting areas.

2. The vehicular marker lamp according to claim 1, wherein said light source is comprised of a plurality of light emitting diodes.

3. The vehicular marker lamp according to claim 1, wherein a light source of said main light emitting portion is used also for said light source of said auxiliary light emitting portion.

4. The vehicular marker lamp according to claim 1, wherein said main light emitting portion is disposed at a apex position of said substantially fan shape.

5. The vehicular marker lamp according to claim 1, wherein said main light emitting portion is disposed in an outer edge region of said vehicular marker lamp.

6. The vehicular marker lamp according to claim 5, wherein:

a plurality of reflective elements that reflect light incident from said light source in a forward direction of said vehicular marker lamp are formed in a stepped configuration on each of said plurality of belt-shaped reflecting areas.

7. The vehicular marker lamp according to claim 1, wherein said main light emitting portion is comprised of plurality of types of main light emitting portions that respectively have different lamp function colors, and said light guide plate of said auxiliary light emitting portion emits light with a color substantially identical to said lamp function color of said main light emitting portion when at least one of said plurality of types of main light emitting portion is lit.

8. The vehicular marker lamp according to claim 7, wherein said auxiliary light emitting portion is comprised of a plurality of types of light sources and is structured such that when said plurality of type of main light emitting portions are turned on and off, light from said plurality of types of light sources is allowed to be incident to said light guide plate.

9. The vehicular marker lamp according to claim 2, wherein a light source of said main light emitting portion is used also for said light source of said auxiliary light emitting portion.

10. The vehicular marker lamp according claim 9, wherein said main light emitting portion is disposed at a apex position of said substantially fan shape.

11. The vehicular marker lamp according to claim 9, wherein said main light emitting portion is disposed in an outer edge region of said vehicular marker lamp.

12. The vehicular marker lamp according to claim 10, wherein:

a plurality of reflective elements that reflect light incident from said light source in a forward direction of said vehicular marker lamp are formed in a stepped configuration on each of said plurality of belt-shaped reflecting areas.

13. The vehicular marker lamp according to claim 11, wherein:

a plurality of reflective elements that reflect light incident from said light source in a forward direction of said vehicular marker lamp are formed in a stepped configuration on each of said plurality of belt-shaped reflecting areas.

14. The vehicular marker lamp according to claim 9, wherein said main light emitting portion is comprised of plurality of types of main light emitting portions that reflectively have different lamp function colors, and said light guide plate of said auxiliary light emitting portion emits light with a color substantially identical to said lamp function color of said main light emitting portion when at least one of said plurality of types of main light emitting portion is lit.

15. The vehicular marker lamp according to claim 14, wherein said auxiliary light emitting portion is comprised of a plurality of types of light sources and is structured such that when said plurality of type of main light emitting portions are turned on and off, light from said plurality of types of light sources is allowed to be incident to said light guide plate.

* * * * *